US006499878B1

(12) United States Patent
Dobreski et al.

(10) Patent No.: US 6,499,878 B1
(45) Date of Patent: Dec. 31, 2002

(54) RECLOSABLE PACKAGES WITH BARRIER PROPERTIES

(75) Inventors: David V. Dobreski, Fairport, NY (US); Steve P. Long, Canandaigua, NY (US); Toby R. Thomas, Pittsford, NY (US)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 09/468,165

(22) Filed: Dec. 21, 1999

(51) Int. Cl.[7] ..... B65D 33/34
(52) U.S. Cl. ..... 383/5; 383/61.2; 383/64
(58) Field of Search ..... 383/61, 64, 63, 383/65, 5

(56) References Cited

U.S. PATENT DOCUMENTS

| | | | | |
|---|---|---|---|---|
| 1,992,152 | A | 2/1935 | Yeates | 150/1 |
| 2,506,311 | A | 5/1950 | Moore | 229/53 |
| 2,560,535 | A | 7/1951 | Allen | 229/76 |
| 2,898,027 | A | 8/1959 | Scholle | 229/14 |
| 2,978,769 | A | 4/1961 | Harrah | 24/201 |
| 3,104,798 | A | 9/1963 | Stone | 229/62 |
| 3,172,443 | A | 3/1965 | Ausnit | 150/3 |
| 3,181,583 | A | 5/1965 | Lingenfelter | 150/3 |
| 3,198,228 | A | 8/1965 | Naito | 150/3 |
| 3,206,354 | A | 9/1965 | Pooley | 161/161 |
| 3,282,493 | A | 11/1966 | Kamins et al. | 229/54 |
| 3,313,471 | A | 4/1967 | Dickard et al. | 229/62 |
| 3,325,084 | A | 6/1967 | Ausnit | 229/77 |
| 3,326,399 | A | 6/1967 | Ausnit | 215/3 |
| 3,387,640 | A | 6/1968 | Butler | 150/7 |
| 3,396,062 | A | 8/1968 | White | 156/244 |
| 3,456,867 | A | 7/1969 | Repko | 229/66 |
| 3,462,068 | A | 8/1969 | Suominen | 229/54 |
| 3,471,005 | A | 10/1969 | Sexstone | 206/41 |
| 3,473,589 | A | 10/1969 | Gotz | 150/3 |
| 3,524,795 | A | 8/1970 | Peterson | 161/165 |
| 3,543,343 | A | 12/1970 | Staller et al. | 18/14 |
| 3,616,020 | A | 10/1971 | Whelan et al. | 156/244 |
| 3,625,270 | A | 12/1971 | Skendzie | 150/3 |
| 3,633,642 | A | 1/1972 | Siegel | 150/3 |
| 3,669,794 | A | 6/1972 | Mazur | 156/244 |
| 3,746,215 | A | 7/1973 | Ausnit et al. | 222/92 |
| 3,780,781 | A | 12/1973 | Uramoto | 150/3 |

(List continued on next page.)

FOREIGN PATENT DOCUMENTS

| | | | |
|---|---|---|---|
| CA | 996018 | 8/1976 | 154/140 |
| EP | 0 239 319 A2 | 3/1987 | 87/40 |
| FR | 1551228 | 12/1968 | 383/207 |
| GB | 2 130 173 A | 11/1982 | B65D/33/30 |
| JP | 57 105248 | 6/1982 | B02B/3/06 |
| JP | 84-12467 | 1/1984 | B29C/47/04 |

OTHER PUBLICATIONS

Plastics Institute of America, Inc. *Plastics in Food Packaging: Proceedings from the Eighth Annual FoodPlas Conference; Barrier Polymer/Technology*; pp. 260–271 (date unknown).

*Primary Examiner*—Stephen P. Garbe
(74) *Attorney, Agent, or Firm*—Jenkens & Gilchrist

(57) ABSTRACT

A reclosable package includes a pair of opposing walls, a reclosable seal and a barrier partition. The pair of opposing wall panels are joined along a pair of opposing sides and a bottom bridges the opposing sides to create a receptacle space having a mouth end opposite the bottom. The reclosable seal extends along the mouth end and includes first and second opposing reclosable elements. The first and second reclosable elements are releasably engageable to each other. The barrier partition comprises at least a first layer that is substantially impermeable to at least one of oxygen, nitrogen and carbon dioxide. The barrier partition extends substantially across the pair of opposing wall panels in the receptacle space.

82 Claims, 4 Drawing Sheets

U.S. PATENT DOCUMENTS 3,940,001 A 2/1976 Haefner et al. ..... 215/1 C
3,977,153 A 8/1976 Schrenk ..... 53/40
3,991,801 A 11/1976 Ausnit ..... 150/3
4,013,745 A 3/1977 Brinkmann et al. ..... 264/37
4,086,045 A 4/1978 Thiel et al. ..... 425/326.1
4,128,695 A 12/1978 Kikuchi et al. ..... 428/423
4,189,050 A 2/1980 Jensen et al. ..... 206/245
4,191,230 A 3/1980 Ausnit ..... 383/61
4,196,030 A 4/1980 Ausnit ..... 156/91
4,234,663 A 11/1980 Catte et al. ..... 428/517
4,235,653 A 11/1980 Ausnit ..... 156/91
4,241,865 A 12/1980 Ferrell ..... 229/62
4,249,982 A 2/1981 Ausnit ..... 156/461
4,252,238 A 2/1981 Spiegelberg et al. ..... 206/210
4,285,376 A 8/1981 Ausnit ..... 383/61
4,287,147 A 9/1981 Hungerford ..... 264/146
4,402,889 A 9/1983 Bonis ..... 264/37
4,410,602 A 10/1983 Komoda et al. ..... 428/516
4,428,477 A 1/1984 Cristofolo ..... 206/210
4,518,087 A 5/1985 Goglio ..... 206/632
4,573,203 A 2/1986 Peppiatt ..... 383/8
4,576,995 A 3/1986 Nakabayashi et al. ..... 525/285
4,617,683 A 10/1986 Christoff ..... 383/63
4,647,509 A 3/1987 Wallace et al. ..... 428/474.9
4,652,325 A 3/1987 Benge et al. ..... 156/244.11
4,705,708 A 11/1987 Briggs et al. ..... 428/35
4,713,839 A 12/1987 Peppiatt ..... 383/29
4,736,450 A 4/1988 Van Erden et al ..... 383/65
4,744,674 A 5/1988 Nocek ..... 383/63
4,753,845 A 6/1988 Sumi et al. ..... 428/327
4,782,951 A 11/1988 Griesbach et al. ..... 206/484
4,786,190 A 11/1988 Van Erden et al. ..... 383/61
4,791,107 A 12/1988 Nocek et al
4,808,482 A 2/1989 Benge et al. ..... 428/411.1
4,846,585 A 7/1989 Boeckmann et al. ..... 383/5
4,847,148 A 7/1989 Schirmer ..... 428/332
4,877,336 A 10/1989 Peppiatt ..... 383/8
4,894,975 A 1/1990 Ausnit
4,923,309 A 5/1990 VanErden ..... 383/5
4,925,316 A 5/1990 Van Erden et al. ..... 383/61
4,927,271 A 5/1990 Branson
4,966,470 A 10/1990 Thompson et al.
4,971,454 A 11/1990 Branson ..... 383/61
5,023,122 A 6/1991 Boeckmann et al.
5,033,868 A 7/1991 Peppiatt ..... 383/29
RE33,674 E 8/1991 Uramoto ..... 206/620
5,050,736 A 9/1991 Griesbach et al. ..... 383/61
5,077,064 A 12/1991 Hustad et al. ..... 383/61
5,092,684 A 3/1992 Weeks ..... 383/61
5,092,831 A * 3/1992 James et al. ..... 493/394
5,100,246 A 3/1992 LaPierre et al. ..... 383/204
5,112,138 A * 5/1992 Peppiatt ..... 383/29
5,116,301 A * 5/1992 Robinson et al. ..... 493/215
5,118,561 A 6/1992 Gusavage et al. ..... 428/304.4
5,121,997 A * 6/1992 La Pierre et al. ..... 383/203
5,128,196 A 7/1992 Luetkens, Jr. et al. ..... 428/213
5,129,734 A * 7/1992 Van Erden ..... 383/61
5,186,543 A * 2/1993 Cochran ..... 383/203
5,221,395 A 6/1993 Luetkens, Jr. et al. .. 156/244.11
5,224,779 A 7/1993 Thompson et al. ..... 383/5
RE34,554 E * 3/1994 Ausnit ..... 383/63
5,330,269 A 7/1994 Kamada et al. ..... 383/5
5,354,402 A 10/1994 Luetkens, Jr. et al. .. 156/244.11
5,405,629 A 4/1995 Marnocha et al. ..... 383/5
5,425,825 A * 6/1995 Rasko et al. ..... 156/66
5,435,864 A * 7/1995 Machacek et al. ..... 156/66
5,456,928 A 10/1995 Hustad et al. ..... 383/5
5,462,794 A 10/1995 Lindemann et al. ..... 428/317.1
5,487,940 A 1/1996 Bianchini et al. ..... 428/349
5,492,411 A 2/1996 May
5,509,735 A 4/1996 May
5,512,338 A 4/1996 Bianchini et al. ..... 428/35.4
5,582,853 A 12/1996 Marnocha et al.
5,635,261 A 6/1997 Georgelos et al. ..... 428/35.4
5,647,671 A 7/1997 May
5,669,715 A 9/1997 Dobreski et al. ..... 383/5
5,713,669 A 2/1998 Thomas et al.
5,725,312 A 3/1998 May
5,769,772 A 6/1998 Wiley
5,776,618 A 7/1998 Lu ..... 428/500
5,811,142 A 9/1998 DelDuca et al. ..... 426/424
5,851,070 A 12/1998 Dobreski et al.
5,911,508 A 6/1999 Dobreski et al
5,919,535 A 7/1999 Dobreski et al.
5,956,924 A 9/1999 Thieman
5,964,532 A 10/1999 St. Phillips et al. ..... 383/5
6,010,244 A 1/2000 Dobreski et al.
6,040,033 A 3/2000 Johnson ..... 428/99
6,212,857 B1 4/2001 Van Erden
6,247,843 B1 6/2001 Buchman
6,257,763 B1 7/2001 Stolmeier et al.
6,264,366 B1 7/2001 Custer
6,273,607 B1 8/2001 Buchman
6,287,000 B1 9/2001 Buchman
6,290,390 B1 9/2001 Buchman
6,290,391 B1 9/2001 Buchman

* cited by examiner

RECLOSABLE PACKAGES WITH BARRIER PROPERTIES

FIELD OF INVENTION

The present invention relates generally to reclosable packages with barrier properties. More particularly, the present invention relates to the use of particular materials as partitions that are substantially impermeable to at least one of oxygen, nitrogen and carbon dioxide.

BACKGROUND OF THE INVENTION

Reclosable packages or bags are very common, especially in the food industry. Such packages are typically made to be reclosable via the use of a reclosable element or fastener such as a resealable adhesive seal or a reclosable zipper. Such zippers may be opened and closed either by pressure or by the use of an auxiliary slider mechanism.

Reclosable packages are a great convenience to consumers, especially for products such as luncheon meats and cheeses where, typically, only a portion of the product is used at any given time. One problem with these reclosable packages, however, is that the packages are not substantially impermeable to various gases such as oxygen, nitrogen and carbon dioxide. These gases may enter into the packages from the external atmosphere causing food spoilage.

One attempt to address this problem has involved encapsulating the reclosable feature by extending the wall panels of the package. One disadvantage of this type of package is that the extended wall panels may interfere with the operation of opening and closing the package, resulting in customer dissatisfaction. Another disadvantage includes higher product costs involved with using additional resins for extending the wall panels. This type of package also involves an additional step for the customer of removing a tear strip or manually cutting the wall panels to gain access to the package.

A need therefore exists for packages or bags being substantially impermeable to gases such as oxygen, nitrogen and carbon without having the above-noted disadvantages.

SUMMARY OF THE INVENTION

According to one embodiment of the present invention, a reclosable package includes a pair of opposing walls, a reclosable seal and a barrier partition. The pair of opposing wall panels are joined along a pair of opposing sides and a bottom bridges the opposing sides to create a receptacle space having a mouth end opposite the bottom. The reclosable seal extends along the mouth end and includes first and second opposing reclosable elements. The first and second reclosable elements are releasably engageable to each other. The barrier partition comprises at least a first layer that is substantially impermeable to at least one of oxygen, nitrogen and carbon dioxide. The barrier partition extends substantially across the pair of opposing wall panels in the receptacle space.

According to another embodiment, a reclosable package includes a pair of opposing walls, a reclosable seal and a barrier partition. The reclosable seal extends along the mouth end and includes first and second opposing tracks. The first and second tracks include respective first and second profiles. The first and second opposing tracks are releasably engageable to each other. The first and second tracks are connected to the respective opposing wall panels. The first and second profiles include at least a first layer that is substantially impermeable to at least one of oxygen, nitrogen and carbon dioxide. The barrier means are proximate to upper edges of the respective first and second profiles. The barrier means are substantially impermeable to at least one of oxygen, nitrogen and carbon dioxide.

According to another embodiment, a reclosable package includes a barrier partition comprising at least a first layer that includes a material selected from the group consisting of vinyl alcohol, polyvinyl alcohol, nylon, polyester, ethylene vinyl dichloride, liquid crystal polymer, polyvinyl chloride, polyvinylidene chloride, modified polyolefins with barrier properties, polyacrylonitrile, acrylonitriles copolymers, polyacetal, cellophane or combinations thereof.

According to a further embodiment, a fastener of the present invention includes first and second opposing elements, a first fin portion and a second fin portion. The first and second opposing reclosable elements are releasably engageable to each other. The first fin portion extends downward from the first reclosable element. The first fin portion comprises at least a first layer that is substantially impermeable to at least one of oxygen, nitrogen and carbon dioxide. The second fin portion extends downward from the second reclosable element. The second fin portion comprises at least a first layer that is substantially impermeable to at least one of oxygen, nitrogen and carbon dioxide. The second fin portion and the first fin portion are joined to each other.

According to a yet another embodiment, a fastener of the present invention includes first and second opposing tracks that are releasably engageable to each other. The first and second opposing tracks have a first and second profile, respectively. The first and second profiles comprise at least a first layer that is substantially impermeable to at least one of oxygen, nitrogen and carbon dioxide.

According to one process of the present invention, a coating is applied to a reclosable bag. The provided reclosable bag comprises a pair of opposing wall panels joined along a pair of opposing sides and a bottom bridging the opposing sides to create a receptacle space having a mouth end opposite the bottom. A reclosable seal extends along the mouth end and includes first and second opposing tracks. The first and second tracks include respective first and second profiles. The first and second opposing tracks are releasably engageable to each other. The first and second tracks are connected to the respective opposing wall panels. The process also includes applying a coating to at least a portion of the first and second tracks. The coating includes at least a first layer that is substantially impermeable to at least one of oxygen, nitrogen and carbon dioxide.

BRIEF DESCRIPTION OF THE DRAWINGS

Other objects and advantages of the invention will become apparent upon reading the following detailed description and upon reference to the drawings.

Figure 1:
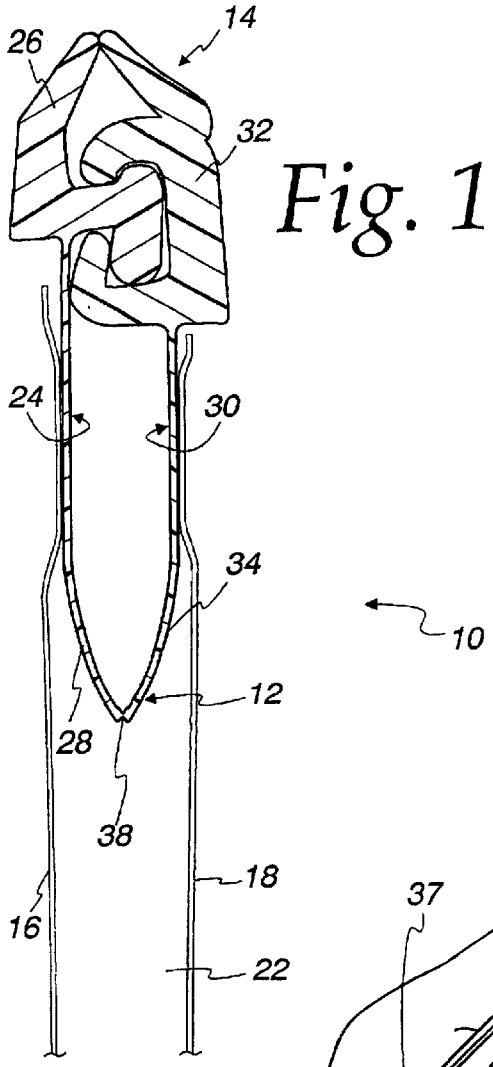
FIG. 1 is a section view of a mouth portion of a reclosable package or bag having fin portions joined below a fastener according to one embodiment of the present invention.

While the invention is susceptible to various modifications and alternative forms, specific embodiments thereof have been shown by way of example in the drawing and will herein be described in detail. It should be understood, however, that it is not intended to limit the invention to the particular forms disclosed but, on the contrary, the intention is to cover all modifications, equivalents, and alternatives falling within the spirit and scope of the invention as defined by the appended claims.

DESCRIPTION OF ILLUSTRATIVE EMBODIMENTS

Figure 2:
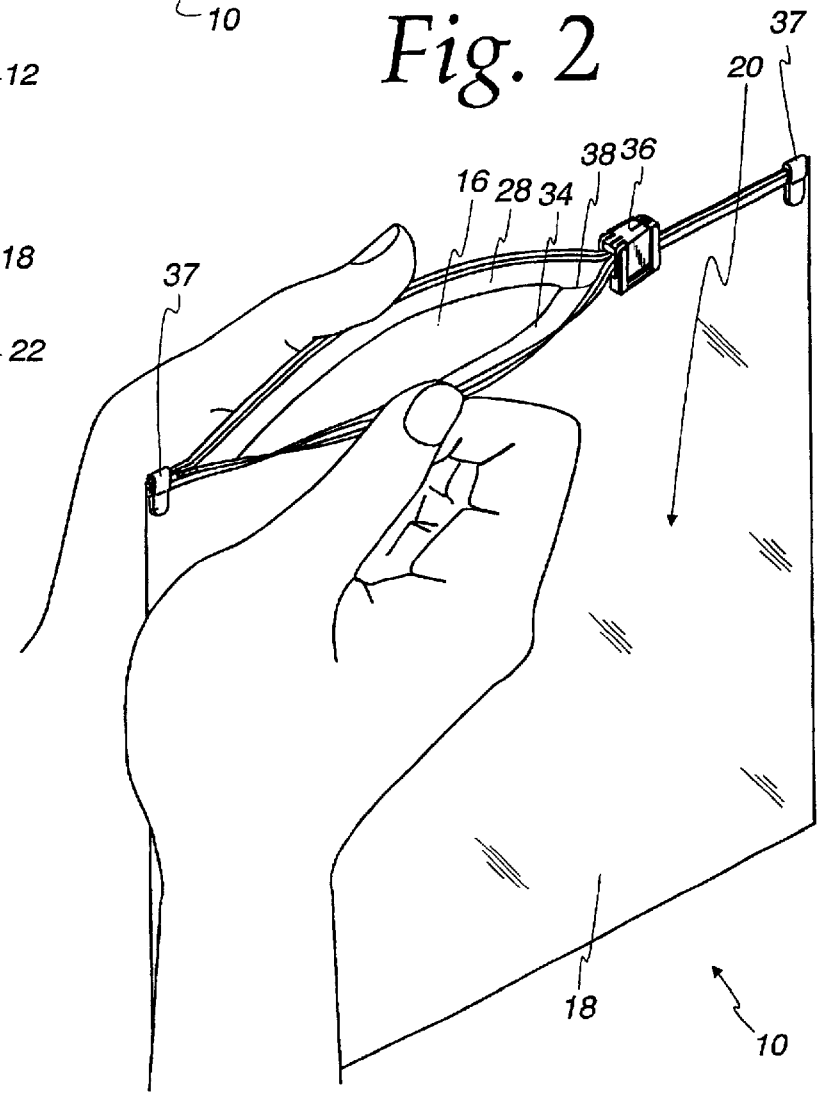
FIG. 2 is a perspective view of the reclosable package incorporating the mouth portion depicted in FIG. 1 in which a reclosable zipper has a slider mechanism being opened and the fin portions being partially opened.

Turning now to the drawings, FIG. 1 depicts a mouth portion of a reclosable package or bag 10 having a barrier partition 12 located below a fastener or zipper 14. The barrier partition 12 of FIG. 1 is also tamper-evident. FIG. 2 shows the reclosable package 10 opening the mouth portion depicted in FIG. 1.

Referring to FIGS. 1 and 2, the mouth portion of the reclosable package 10 includes a pair of opposing wall panels 16 and 18 that make up a package body 20 and define a receptacle space 22. Connected to the wall panel 16 is a first track 24 having a first profile 26 and a first fin portion 28 extending downward from the first profile 26. Connected to the other wall panel 18 is a second track 30 having a second profile 32 and a second fin portion 34 extending downward from the second profile 32. The first and second profiles 26 and 32 are releasably engageable with each other to provide a reclosable seal to the package 10.

The barrier partition 12 comprises at least a first layer that is substantially impermeable to at least one of oxygen, nitrogen and carbon dioxide. As shown in FIG. 1, the barrier partition 12 extends across the pair of opposing wall panels 16 and 18 in the receptacle space 22. The barrier partitions of the present invention are preferably substantially impermeable to oxygen, nitrogen and carbon dioxide.

The first layer of the barrier partition 12 may comprise ethylene vinyl alcohols (EVOH), polyvinyl alcohols (PVOH), nylons, polyesters, ethylene vinyl dichlorides (EVDC), liquid crystal polymers (LCPs), polyvinyl chloride (PVC), polyvinylidene chloride (PVDC), modified polyolefins with barrier properties, polyacrylonitriles, acrylonitrile copolymers, polyacetals, cellophanes or combinations thereof. The first layer of the barrier partition 12 is preferably made of an EVOH, PVDC, nylon or polyester. Preferred nylons include nylon-6, nylon-66, nylon-MXD6 and amorphous nylons. Preferred polyesters include polyethylene terephthlate (PET) and polybutylene terephthlate (PBT). It is preferred that water soluble materials, such as PVOH, do not comprise the first layer if the barrier partition is made of only the first layer because those materials may dissolve in a moisture environment or lose strength and/or barrier characteristics.

The first layer generally has an oxygen transmission rate (OTR) less than 100 $cm^3$ (mil)/100 $in^2$ (d) (atm) at 23° C. as measured by ASTM D3985-81. The first layer preferably has an oxygen transmission rate less than 20 $cm^3$ (mil)/100 $in^2$ (d) (atm) at 23° C. and, more preferably, less than 10 $cm^3$ (mil)/100 $in^2$ (d) (atm) at 23° C. as measured by ASTM D3985-81.

The first layer of the barrier partition 12 may also be substantially impermeable to water vapor and other gases causing dehydration, increased humidification and/or oxidation. The first layer of the barrier partition 12 preferably assists in inhibiting loss of flavor, absorption of external odors and development of microflora (bacteria) in the food products of the package 10.

It is contemplated that oxygen absorbers/scavengers may be included in the formation of the first layer of the barrier partition 12. Oxygen absorbers or scavengers are generally chemical or enzyme based. Chemical oxygen scavengers contemplated in the present invention include metallic reducing agents such as various ferrous compounds, powdered iron oxide and metallic platinum. Other chemical oxygen scavengers include non-metallic formulations such as those employing ascorbic acids (Vitamin C) and their associated salts and organo-metallic molecules that have a natural affinity for oxygen.

It is contemplated that additional materials may be added in forming the barrier partition 12. These materials include various fillers, such as clay, talc, mica and nanocomposites that may be more cost effective. These fillers may provide a tortuous path for oxygen, nitrogen or carbon dioxide.

Similarly, the opposing wall panels 16 and 18 are also made of at least one layer that is substantially impermeable to at least one of oxygen, nitrogen and carbon dioxide and, preferably, substantially impermeable to all of the above. The first layer of the opposing wall panels 16 and 18 may be made of similar material as described above in forming the first layer of the barrier partition 12. The opposing wall panels 16 and 18 may be made from multiple layers. The first layer of the opposing wall panels 16 and 18 may be located on the inside layer or as an interior layer.

One example of an opposing wall panel 16 or 18 is a three layer structure with the first layer comprising polyester and being located as an outside layer of the wall panels, a second layer comprising polyolefin that is located on the interior, and a third layer being a tie layer located between the first and second layers. The tie layer may be made from, for example, ethylene vinyl acetate (EVA) or a modified EVA. The first layer of the opposing wall panels 16 and 18 may be made of nylon. Polyolefins that are typically used in forming the second layer of the opposing wall panels 16 and 18 include polyethylenes and polypropylenes.

It is contemplated that various other layered structures may form the opposing wall panels 16 and 18. For example, the opposing wall panels 16 and 18 may have a layer of EVA and a layer of polyester. Alternatively, the opposing wall panels 16 and 18 may have an EVA layer and a layer of nylon. The layers of each of the opposing wall panels may be joined by coextrusion, extrusion lamination or adhesive lamination. It is also contemplated that pigments, metallic components, paper, and/or paper/polymeric compositions may be incorporated into layer(s) forming the opposing wall panels 16 and 18 of the present invention.

In the illustrated embodiment of FIG. 1, the lower edges of the first and second fin portions 28 and 34 are joined to each other along an optional one-time breakable preferential area of weakness or preferential tear area 38 to form a one-time breakable tamper evident feature. The optional preferential area of weakness 38 is substantially impermeable to at least one of oxygen, nitrogen and carbon dioxide and, preferably, substantially impermeable to all of the above. It is not necessary that the first and second fin portions 28 and 34 have a one-time breakable preferential area of weakness 38. For example, the first and second fin portions 28 and 34 may be made in a manner such that the fin portions 28 and 34 are separated by cutting the fin portions apart. The preferential area of weakness 38 inhibits tampering with the bag 10 prior to being opened. The joined first and second fin portions 28 and 34 have a generally U-shaped or V-shaped cross-sectional configuration.

To join the first and second fin portions 28 and 34, the first and second fin portions 28 and 34 may be extruded as a single continuous fin having the preferential area of weakness 38. In one embodiment, the preferential area of weakness 38 takes the form of a score line or a thinned line. A score line may be created by making a uniform crease at the intersection of the fin portions 28 and 34. Alternatively, a score line may be formed on any portion(s) of the fin portions 28 and 34. A thinned line is created by extruding the fin portions 28 and 34 with less plastic material along the region joining the lower edges of the fin portions 28 and 34. In another embodiment, the preferential area of weakness 38 results from forming the single continuous fin out of a region of highly oriented plastic that has a tendency to split along the preferential area of weakness 38.

Instead of extruding the first and second fin portions 28 and 34 as a single continuous fin, the fin portions 28 and 34 may be separately extruded and then later weakly attached at their lower edges or some other location by heat sealing, welding, or the like. The weak attachment of the first and second fin portions 28 and 34 creates the preferential area of weakness 38.

The thicknesses of the first and second fin portions 28 and 34 may vary from generally about 2 to about 10 mil. The thicknesses of the first and second fin portions 28 and 34 are typically from about 6 to about 8 mil.

The reclosable package 10 may further include an optional auxiliary slider mechanism 36 (FIG. 2) slidably mounted to the zipper 14 for movement between a closed position and an open position. The first and second profiles 26 and 32 are engaged to each other while the slider mechanism 36 is in the closed position, and movement of the slider mechanism 36 from the closed position to the open position disengages the profiles 26 and 32 from each other. The package 10 of FIG. 2 also includes end termination clamps 37. The end clamps 37 perform the dual function of stops for the ends of the zipper 14 to prevent the slider 36 from going past the zipper 14 and, in addition, the end clamps 37 hold the first and second profiles 26 and 32 together to resist stresses applied to the profiles during normal use of the package 10. The composition and manner of operation of this zipper, slider arrangement and end clamps is described in detail in U.S. Pat. No. 5,067,208 to Herrington, Jr. et. al., which is incorporated herein by reference in its entirety.

As illustrated in FIG. 2, in order to open the reclosable package 10 of the present invention, a consumer grips the slider mechanism 36 and moves it such that the first and second profiles 26 and 32 of the respective first and second tracks 24 and 30 are detached from each other. Next, the consumer tears open the barrier partition 12 along the preferential area of weakness 38. Alternatively, the consumer may open the barrier partition 12 by cutting the first and second fin portions 28 and 34. The package can be resealed utilizing the zipper 14 and slider mechanism 36. Specifically, the consumer grips the slider mechanism 36 and moves it from the open position to the closed position so as to engage the complementary first and second profiles 26 and 32.

Figure 3:
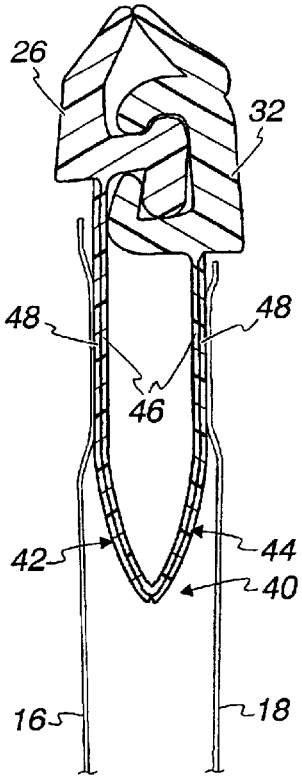
FIG. 3 is a section view of a mouth portion of a reclosable portion having fin portions comprising two layers according to one embodiment of the present invention.

As shown in FIGS. 3–6, barrier partitions of the present invention may be formed of multiple layers. As shown in FIG. 3, a barrier partition 40 comprises a first fin portion 42 and a second fin portion 44. Each of the fin portions 42 and 44 comprises a first layer 46 and a second layer 48. The first layer 46 may comprise the same materials as described above in making the first layer of the barrier partition 12. The first layers of the first and second fin portions may be made of different materials.

The second layer 48 may be connected to the opposing wall panels 16 and 18 as shown in FIG. 3. The second layer 48 is a tie layer and may be made from various is materials such as ethylene vinyl acetate (EVA), anhydride modified polyolefins, anhydride modified ethylene-acrylates, anhydride modified EVAs, acid modified EVAs, acid modified ethylene-acrylates, amorphous polyolefin-modified EVA polymers or combinations thereof. Some examples of anhydride modified polyolefins include anhydride modified high density polyethylene (HDPE), anhydride modified low density polyethylene (LDPE) and anhydride linear low density polyethylene (LLDPE). The second layers of the fin portions may be made of different materials.

Figure 4:
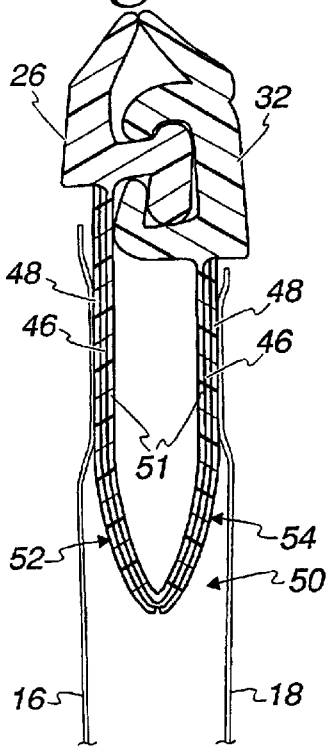
FIG. 4 is a section view of a mouth portion of a reclosable portion having fin portions comprising three layers according to a further embodiment of the present invention.

Referring to FIG. 4, a barrier partition 50 is similar to the barrier partition 40 of FIG. 3 except that it further includes a third layer 51 in both of the first and second fin portions 52 and 54. The third layer 51 of FIG. 4 is a tie layer and may be made of similar materials as described above with respect to the second layer 48. The third layer 51 is located on the interior of the barrier partition 50, such that the first layer 46 is located between the second layer 48 and the third layer 51.

Other barrier partitions having three layers are contemplated. For example, a barrier partition (not shown) may include a first layer having the same materials as described above in making the first layer of the barrier partition 12, a tie layer and a third layer made of polyolefin(s), such as an LDPE, an HDPE, an LLDPE or a combination thereof. In this embodiment, the first layer would be preferably located on the interior of the barrier partition with the tie layer being located between the first and third layers.

Figure 5:
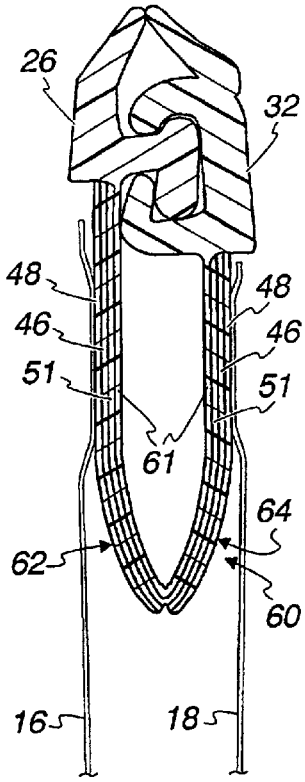
FIG. 5 is a section view of a mouth portion of a reclosable portion having fin portions comprising four layers according to another embodiment of the present invention.
Figure 6:
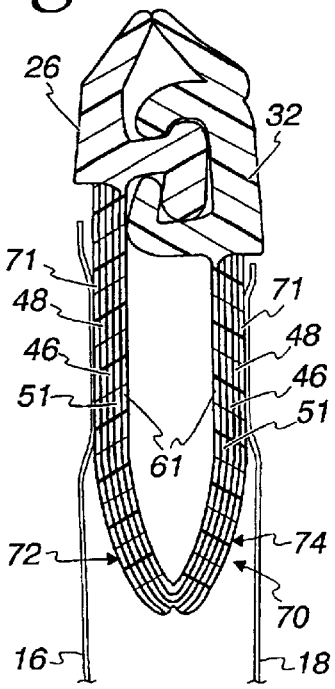
FIG. 6 is a section view of a mouth portion of a reclosable portion having fin portions comprising five layers according to yet another embodiment of the present invention.

The barrier partitions of the present invention may include four layer and five layer fin portions such as shown in barrier partition 60 (see FIG. 5) and in barrier partition 70 (see FIG. 6). Referring first to FIG. 5, the barrier partition 60 further includes a fourth layer 61 in both of the first and second fin portions 62 and 64. The fourth layer 61 of FIG. 5 may be made of polyolefin(s), such as an LDPE, an HDPE, an LLDPE or a combination thereof. As shown in FIG. 5, the fourth layer 61 is located on the interior of the barrier partition 60 and is adjacent to the third layer 51.

Other four layered fin portions are contemplated in the present invention. For example, a four layer structure (not shown) may include two first layers substantially impermeable to at least one of oxygen, nitrogen and carbon dioxide,. a tie layer and a polyolefinic layer. The two first layers may be made with materials that are independently selected from each other, such as described above in the first layer of is the barrier partition 12. In this embodiment, the polyolefinic layer may be located as an exterior layer with the tie layer located adjacent to the polyolefinic layer. The remaining layers are located adjacent to each other with one of the layers being located on an interior layer of the barrier partition.

Referring to FIG. 6, a barrier partition 70 further includes a fifth layer 71 in both of its first and second fin portions 72 and 74. The fifth layer 71 of FIG. 6 may be made of the same materials (polyolefins) as described above with respect to the fourth layer 61.

It is also contemplated that additional layers may be added in forming the first and second fin portions of the present invention. For example, six or seven or more layered first and second fin portions are contemplated in the present invention.

In one preferred three layer fin portion, the first layer 46 is EVOH, the second layer 48 is a tie layer and the third layer 51 is a tie layer. In another preferred three layer fin portion, the first layer 46 is nylon, the second layer 48 is a tie layer and the third layer 51 is a tie layer. In one preferred four layer fin portion, the first layer 46 is EVOH, the second layer 48 is a tie layer, the third layer 51 is a tie layer and the fourth layer 61 is LDPE. In another preferred four layer fin portion, the first layer 46 is nylon, the second layer 48 is a tie layer, the third layer 51 is a tie layer and the fourth layer 61 is LDPE.

In one preferred five layer fin portion, the first layer 46 is EVOH, the second layer 48 is a tie layer, the third layer 51 is a tie layer, and the fourth and fifth layers 61 and 71, respectively, are independently selected polyolefins, such as LDPE, HDPE or LLDPE. In another preferred five layer fin portion, the first layer 46 is nylon, the second layer 48 is a tie layer, the third layer 51 is a tie layer, and the fourth and fifth layers 61 and 71, respectively, are independently selected polyolefins, such as LDPE, HDPE or LLDPE.

The first and second fin portions, such as shown in FIGS. 3–6, may be formed by coextruding the multiple layers that form each fin portion. The first and second fin portions may also be formed by other processes such as coating or laminating.

Figure 7:
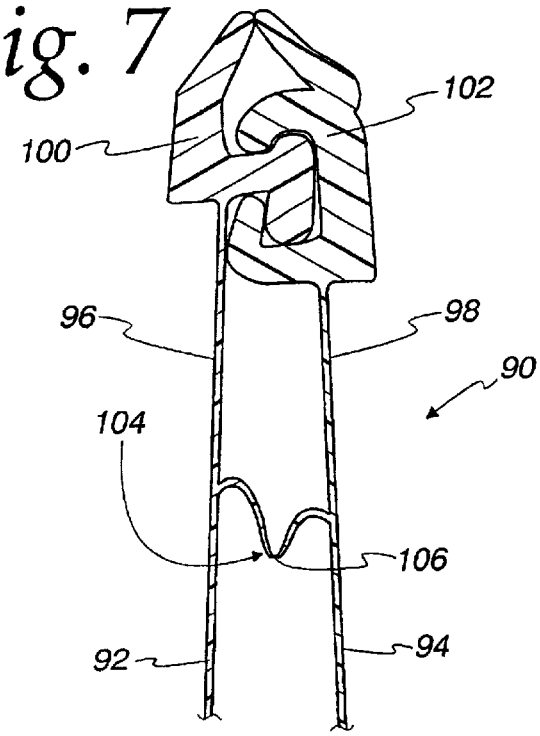
FIG. 7 is a section view of a mouth portion of a reclosable package having a barrier partition formed by integral extensions of opposing wall panels located below a fastener.

In an alternative embodiment depicted in FIG. 7, a mouth portion 90 includes wall panel portions 92 and 94, first and second tracks 96 and 98, and first and second profiles 100 and 102. The first and second tracks 96 and 98 are coextruded with the respective wall panels 92 and 94. The mouth portion also includes a barrier partition 104 that is formed by integral extensions of the wall panel portions 92 and 94. Alternatively, a barrier partition may be formed by an integral extension of only one of the wall panel portions 92 and 94 (not shown). The barrier partition 104 of FIG. 7 is also tamper resistant. The barrier portion 104 may include an optional one-time breakable preferential area of weakness 106, such as shown in FIG. 7.

By being substantially impermeable to at least oxygen, nitrogen and/or carbon dioxide, the barrier partitions of the present invention assist in preserving the freshness of the food contents of the package prior to its initial opening. Since the fastener is located above the barrier partitions, the operation of the fastener is not hampered by the presence of a barrier partition. The barrier partition of the present invention also provides a consumer with the assurance that the newly purchased package has not been opened.

The optional slider mechanism 36 is optimally made from polypropylenes, copolymers of polyethylene and polypropylene, polycarbonates or polyesters. Especially preferred components for making the slider mechanism 36 are polypropylenes, polycarbonates or polyesters.

The components of the fastener such as the tracks having integrally formed interlocking profiles and fin portions may be attached to the wall panels of the package by processes such as heat sealing, welding or blocking. The process utilized depends upon the materials from which the bag and the fastener are made. Specifically, heat sealing is a process whereby materials are fused or melted together. Welding is a process where an intermediate third material is utilized to "glue" similar materials to each other. Blocking is a process where at least sufficient pressure and optional temperature increases result in intimate surface contact adhesion of layers without sealing.

Alternatively, an adhesive seal may be utilized as a fastener or reclosable element of the present invention. Such seals employ a resealable adhesive-type substance that is applied to either one or both of the films making up the package. The adhesive may alternatively be applied to an intermediary base strip. It is contemplated that other fasteners, besides adhesive seals and zippers, may be used in the present invention.

Figure 8:
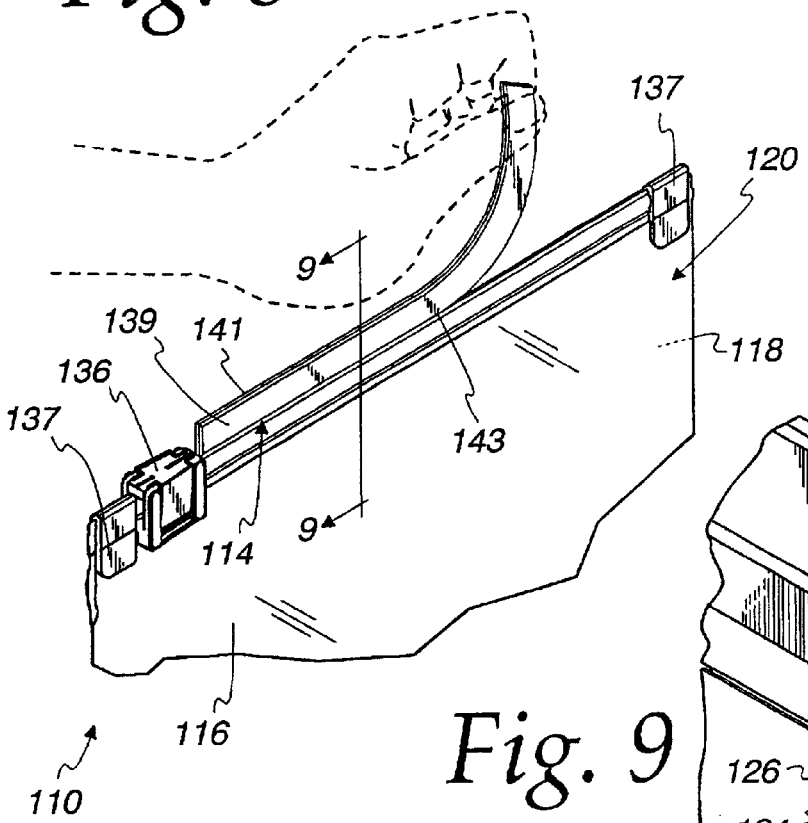
FIG. 8 is a perspective view of a reclosable package according to one embodiment of the present invention, showing the package in sealed form having upstanding fins in the process of being broken.
Figure 9:
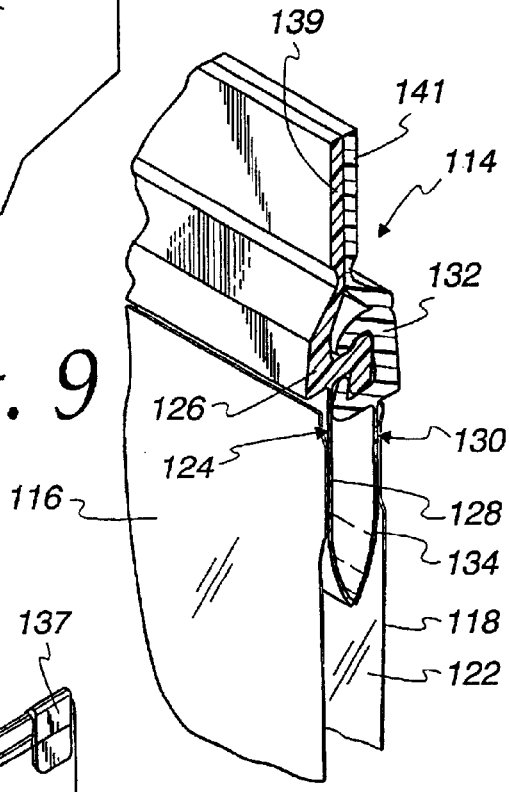
FIG. 9 is an enlarged section view taken generally along line 9—9 of FIG. 8.
Figure 10:
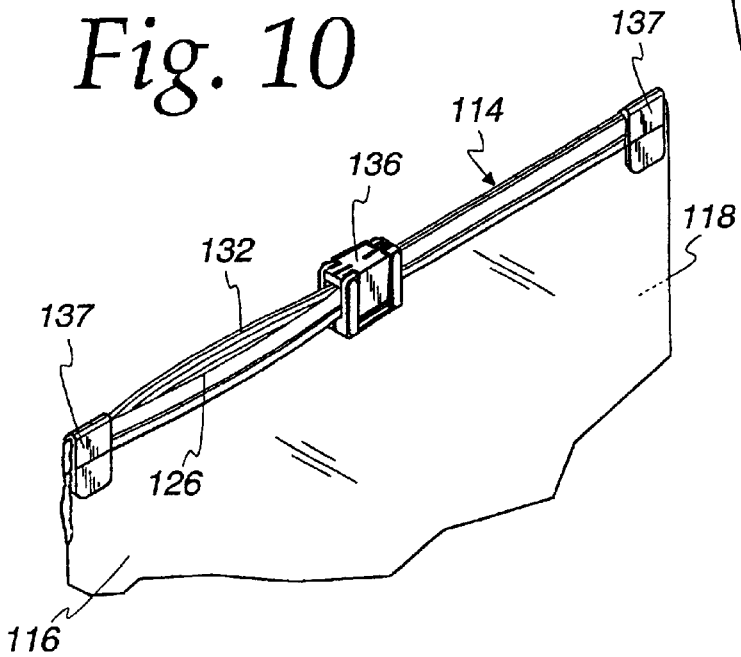
FIG. 10 is a perspective view of the reclosable bag, showing the bag in partially opened form after the upstanding fins have been completely broken.

Referring to FIGS. 8–10, a reclosable package or bag 110 is shown according to another embodiment of the present invention. The reclosable package 110 includes a fastener or zipper 114 extending along a mouth formed opposite of a sealed bottom. The package 110 comprises first and second opposing panels 116 and 118 that make up a package body 120 and define a receptacle space 122. Connected to the wall panel 116 is a first track 124 having a first profile 126 and a first fin portion 128 extending downward from the first profile 126. Connected to the other wall panel 118 is a second track 130 having a second profile 132 and a second fin portion 134 extending downward from the second profile 132. The first and second profiles 126 and 132 are releasably engageable with each other to provide a reclosable seal to the package 110.

Referring still to FIGS. 8–10, the package 110 further has an optional auxiliary slider mechanism 136 and end clamps 137 that function as described above in the slider mechanism 36 and the end clamps 37 of FIGS. 1 and 2.

To inhibit tampering with the contents of the package 110 prior to being initially opened, the slider 136 is initially parked in the closed position at one end of the zipper 114 as depicted in FIG. 8. Moreover, upper edges of the first and second profiles 126 and 132 are detachably connected to each other, except at one end of the zipper 114 supporting the parked slider 136, such that the slider 136 cannot be moved from the closed position until the barrier feature is broken.

As shown in FIGS. 8 and 9, the package 110 is provided with first and second upstanding fins or flanges 139 and 141 that extend upward from the respective first and second profiles 126 and 132. The first and second upstanding fins 139 and 141 are detachably connected to their respective first and second profiles 126 and 132 along a preferential area of weakness 143 and are fused to each other so as to effectively connect the upper edges of the first and second profiles 126 and 132.

The preferential area of weakness 143 may be in the form of a scored line, a thinned line or highly orientated material. The first and second upstanding fins 139 and 141 extend substantially across the bag mouth, with the exception that the fins 139 and 141 do not occupy the end portion of the zipper 114 supporting the slider 136 while the slider 136 is in the closed position. If a slider is not used, the first and second upstanding fins 139 and 141 may extend across the entire bag mouth. Alternatively, the first and second upstanding fins 139 and 141 may be removed by cutting the upstanding fins from a remainder of the package 110.

The slider 136 is retained in the closed position by the ends of the first and second upstanding fins 139 and 141, thereby preventing access via the bag mouth to the interior of the package 110. The slider 136 cannot be moved from the closed position until the first and second upstanding fins 139 and 141 are detached from the first and second profiles 126 and 132 along the preferential area of weakness 143. To remove the first and second upstanding fins 139 and 141, a consumer first grasps the upstanding fins at one end of the bag mouth as shown in FIG. 8 and then pulls the upstanding fins in an upward direction away from the zipper 114. The pulling force causes the package 110 to tear along the preferential area of weakness 143. Once the first and second upstanding fins 139 and 141 are removed, the connection of the upper edges of the first and second profiles 126 and 132 is broken (because the first and second profiles 126 and 132 are not connected below the preferential area of weakness 143). This allows the slider 136 to be moved to the open position to gain access to the interior of the package 110. FIG. 10 depicts the slider 136 in the process of being moved toward the open position.

Figure 11:
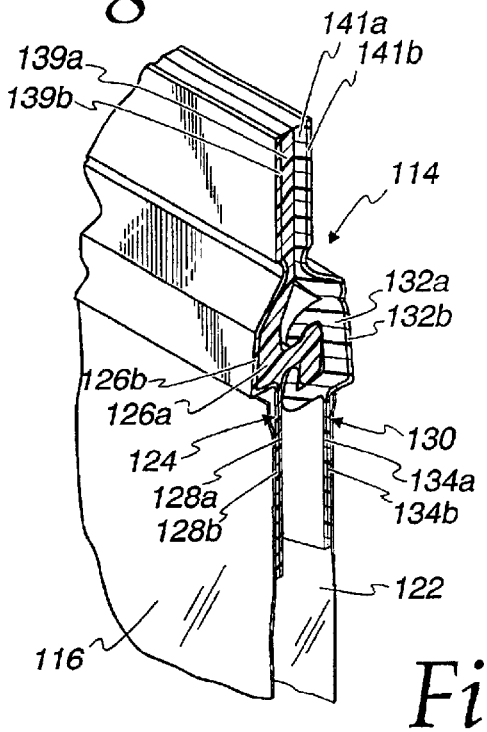
FIG. 11 is an enlarged section view of zipper profiles and upstanding fins comprising two layers according to one embodiment of the present invention.

The first and second upstanding fins 139 and 141 include a first layer that is substantially impermeable to at least one of oxygen, nitrogen and carbon dioxide and, preferably, to oxygen, nitrogen and carbon dioxide. The first and second upstanding fins 139 and 141 may also be formed of multiple layers as discussed above with respect to the fin portions 28 and 34. For example, as shown in FIG. 11, the first and second upstanding fins 139 and 141 include two layers. The first layers 139*a* and 141*a* may comprise a material that is independently selected from the materials made in forming the first layer of the barrier partition 12 described above. Layers 139*b* and 141*b* may be made of independently selected tie layers as described above, for example, in forming the second layer 48 depicted in FIG. 4.

Figure 12:
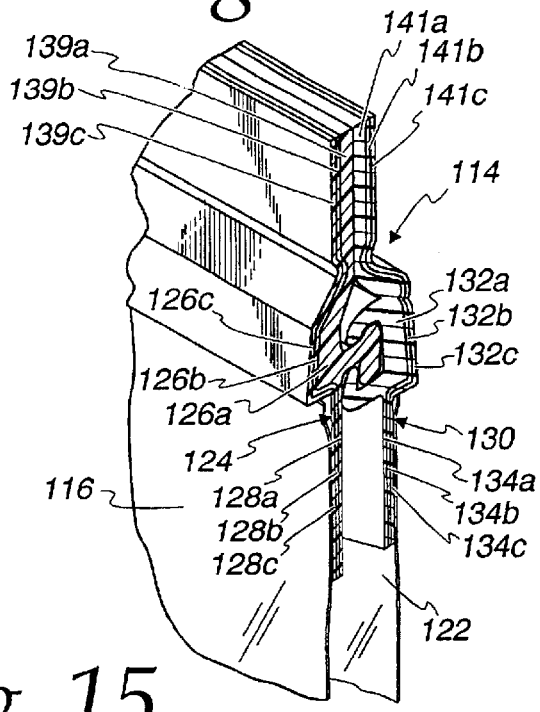
FIG. 12 is an enlarged section view of zipper profiles and upstanding fins comprising three layers according to one embodiment of the present invention.

Another embodiment of the first and second upstanding fins 139 and 141 is depicted in FIG. 12. Each of the first and second upstanding fins 139 and 141 of FIG. 12 has three layers. Layers 139*a*, 139*b*, 141*a* and 141*b* are the same as described above in FIG. 11. Layers 139*c* and 141*c* comprise independently selected polyolefins including the polyolefins described above in forming the fourth layer 61 depicted in FIG. 5.

Prior to being removed, the first and second upstanding fins 139 and 141 also restrict access to the contents of the package 110. If a consumer purchases a prepackaged package 110 with the upstanding fins 139 and 141 intact, it is not likely that the contents of the package 110 have been tampered with because the slider 136 cannot be moved and the bag mouth cannot be opened without first tearing off the upstanding fins 139 and 141. If, on the other hand, the consumer purchases a package 110 with part or all of the fins 139 and 141 detached from the zipper 114 along the preferential area of weakness 143, then it is more likely that the contents of the package 110 have been tampered with. Thus, the upstanding fins 139 and 141 also provide an effective tamper-evident feature for the package 110.

The first and second profiles 126 and 132, as shown, for example, in FIGS. 11 and 12 may have multiple layers. In FIG. 11, the first and second profiles 126 and 132 have respective layers 126*a* and 132*a* comprised of a material that is independently selected from the materials made in forming the first layer of the barrier partition 12 described above. Layers 126*b* and 132*b* of the first and second profiles 126 and 132, respectively, may be made of independently selected tie layers as described above, for example, in forming the second layer 48 depicted in FIG. 4. In FIG. 12, layers 126*c* and 132*c* of the first and second profiles 126 and 132, respectively, comprise independently selected polyolefins, including the polyolefins described above in forming the fourth layer 61 depicted in FIG. 5.

The first and second profiles 126 and 132 may be coated or laminated with a material that is substantially impermeable to at least one of oxygen, nitrogen or carbon dioxide. This coating or lamination may comprise the materials described above in forming the first layer of the barrier partition 12.

It is contemplated that additional materials may be added in forming the first and second profiles 126 and 132. These materials include various fillers, such as clay, talc, mica and nanocomposites which may be more cost effective. These fillers may provide a tortuous path for oxygen, nitrogen or carbon dioxide. These materials may be blended with other materials in the formation of the first and second profiles 126 and 132. These materials may be added in a sufficient amount so that the first and second profiles 126 and 132 are substantially impermeable to at least one of oxygen, nitrogen or carbon dioxide.

Figure 15:
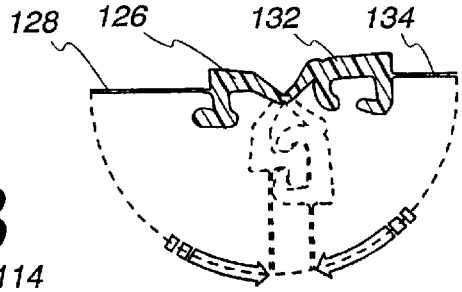
FIG. 15 is a section view of the zipper profiles as extruded with each other end-to-end to achieve the integral connection shown in FIG. 14.
Figure 13:
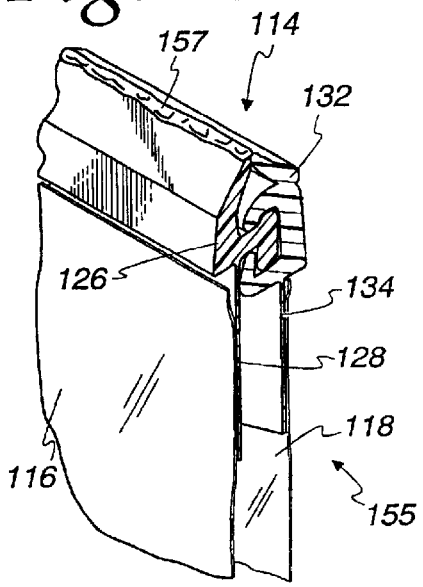
FIG. 13 is an enlarged section view employing a continuous bead of adhesive to connect the zipper profiles.
Figure 14:
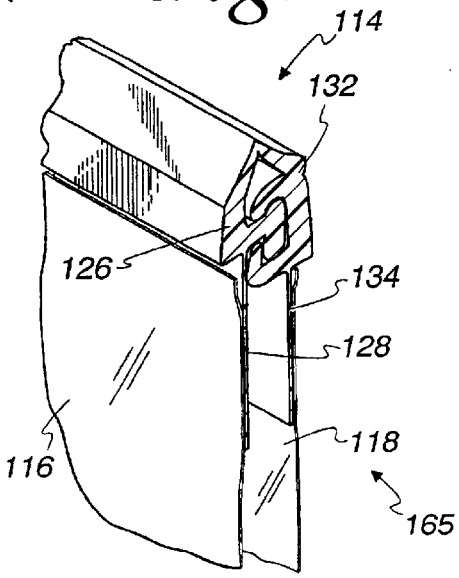
FIG. 14 is an enlarged section view similar to that of FIG. 13 but integrally forming the zipper profiles to connect them to each other.

Referring to FIGS. 13–15, reclosable packages 155 and 165, respectively, employ a barrier feature in accordance with the present invention. Elements of the reclosable packages 155 and 165 in FIGS. 13 and 14, respectively, correspond to elements of the package 110 in FIG. 8 and are designated by the same reference numerals. The reclosable packages 155 and 165 are similar to the package 110 with the exception that the upper edges of the first and second profiles 126 and 132 are directly connected to each other along a line of connection without the use of the upstanding fins 139 and 141 of FIGS. 8–10.

As shown in FIGS. 13–15, barrier features proximate to the upper edges of profiles may be accomplished in several ways. In FIG. 13, a continuous bead of adhesive 157 is applied across the upper edges of the profiles 126 and 132. Alternatively, the upper edges of the profiles may be continuously sealed to each other by thermal fusion. In another embodiment shown in FIG. 14, an upper edge of the first profile 126 is integrally formed with an upper edge of the second profile 132. To achieve this integral connection, the first and second profiles 126 and 132 may be extruded as one piece as shown in FIG. 15 and then folded into an interlocking relationship.

The continuous bead of adhesive 157 (see FIG. 13) is comprised of an adhesive that is substantially impermeable to at least oxygen, nitrogen or carbon dioxide. The continuous bead of adhesive 157 preferably is substantially impermeable to oxygen, nitrogen and carbon dioxide. The impermeability of the adhesive 157 increases when the cross-sectional thickness of the adhesive is increased. The continuous bead of adhesive 157 may be made from hot melt adhesives such as linear saturated polyesters or polyimides, reactive thermosetting adhesives, polyester and polyurethane solutions, solvent and water based adhesives, thermosetting nitrile phenolics, and liquid crystal polymers.

Like the upstanding fins 139 and 141 in FIGS. 8–10, the continuous line of connection of the upper profile edges in FIGS. 13 and 14 extends substantially across the bag mouth. If a slider is used, the line of connection does not occupy the end portion of the zipper 114 supporting the slider 136 while the slider 136 is in a closed position. The movement of the slider 136 from the closed position will break the line of connection formed by, for example, the continuous bead of adhesive 157 of FIG. 13. The slider 136 includes a pointed separator finger (not shown) located between the first and second profiles 126 and 132. As the slider 136 is moved from the closed position to the open position, the separator finger of the slider 136 simultaneously disengages the first and second profiles 126 and 132 from each other and breaks the line of connection along the upper edges of the profiles.

In addition to being a substantially impermeable barrier, the line of connection along the upper profile edges serves as an effective tamper-evident feature because the line of connection restricts access to the contents of the packages 155 and 165. If a consumer purchases a prepackaged package 155 or 165 with the line of connection intact, it is less likely that the contents of the package 155 or 165 have been tampered with.

The packages 155 and 165 of FIGS. 13 and 14, respectively, may have first and second fin portions 128 and 134 made by the same materials as described above in forming the first and second fin portions 26 and 34. The fin portions 128 and 134 may be formed from multi-layers. The packages 155 and 165 of FIGS. 13 and 14, respectively, have first and second profiles 126 and 132 made of a first layer substantially impermeable to at least one of oxygen, nitrogen or carbon dioxide. The first and second profiles 126 and 132 may be formed from multi-layers.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A reclosable package, comprising:

a pair of opposing wall panels joined along a pair of opposing sides and a bottom bridging the opposing sides to create a receptacle space having a mouth end opposite the bottom;

a reclosable seal extending along the mouth end and including first and second opposing reclosable elements, the first and second reclosable elements being releasably engageable to each other; and a barrier partition comprising at least a first layer that is substantially impermeable to at least one of oxygen, nitrogen and carbon dioxide, the barrier partition extending substantially across the pair of opposing wall panels in the receptacle space and being located below the recloseable seal, the barrier partition includes an oxygen scavenger or an oxygen absorber.

2. The reclosable package of claim 1, wherein the barrier partition is formed by first and second fin portions extending downward from the respective first and second reclosable elements and are joined to each other.

3. The reclosable package of claim 1, wherein the barrier partition is formed by at least one integral extension of at least one opposing wall panel.

4. The reclosable package of claim 3, wherein the barrier partition is formed by integral extensions of the opposing wall panels.

5. A reclosable package, comprising:

a pair of opposing wall panels joined along a pair of opposing sides and a bottom bridging the opposing sides to create a receptacle space having a mouth end opposite the bottom;

a reclosable seal extending along the mouth end and including first and second opposing reclosable elements, the first and second reclosable elements being releasably engageable to each other; and a barrier partition comprising at least a first layer that is substantially impermeable to at least one of oxygen, nitrogen and carbon dioxide, the barrier partition extending substantially across the pair of opposing wall panels in the receptacle space and being located below the recloseable seal, the barrier partition includes a filler selected from talc, clay, mica or a nanocomposite.

6. A reclosable package, comprising:

a pair of opposing wall panels joined along a pair of opposing sides and a bottom bridging the opposing sides to create a receptacle space having a mouth end opposite the bottom;

a reclosable seal extending along the mouth end and including first and second opposing reclosable elements, the first and second reclosable elements being releasably engageable to each other; and a barrier partition comprising at least a first layer that includes a material selected from one or more of ethylene vinyl alcohol, polyvinyl alcohol, nylon, polyester, ethylene vinyl dichloride, liquid crystal polymer, polyvinyl chloride, polyvinylidene chloride, modified polyolefins with barrier properties, polyacrylonitrile, acrylonitrile copolymers, polyacetals, or cellophane, the barrier partition extending substantially across the pair of opposing wall panels in the receptacle space and being located below the recloseable seal, the barrier partition includes an oxygen scavenger or an oxygen absorber.

7. The reclosable package of claim 6, wherein the barrier partition is formed by first and second fin portions extending downward from the respective first and second reclosable elements and are joined to each other.

8. The reclosable package of claim 6, wherein the barrier partition is formed by at least one integral extension of at least one opposing wall panel.

9. A reclosable package, comprising:

a pair of opposing wall panels joined along a pair of opposing sides and a bottom bridging the opposing sides to create a receptacle space having a mouth end opposite the bottom;

a reclosable seal extending along the mouth end and including first and second opposing reclosable elements, the first and second reclosable elements being releasably engageable to each other; and a barrier partition comprising at least a first layer that includes a material selected from one or more of ethylene vinyl alcohol, polyvinyl alcohol, nylon, polyester, ethylene vinyl dichloride, liquid crystal polymer, polyvinyl chloride, polyvinylidene chloride, modified polyolefins with barrier properties, polyacrylonitrile, acrylonitrile copolymers, polyacetals, or cellophane, the barrier partition extending substantially across the pair of opposing wall panels in the receptacle space and being located below the recloseable seal, the barrier partition includes a filler selected from talc, clay, mica or a nanocomposite.

10. A fastener to be used in a reclosable bag, the fastener comprising:

first and second opposing reclosable elements, the first and second reclosable elements being releasably engageable to each other;

a first fin portion extending downward from the first reclosable element, the first fin portion comprising at least a first layer that is substantially impermeable to at least one of oxygen, nitrogen and carbon dioxide; and a second fin portion extending downward from the second reclosable element, the second fin portion comprising at least a first layer that is substantially impermeable to at least one of oxygen, nitrogen and carbon dioxide, the second fin portion and the first fin portion being joined to each other.

11. The fastener of claim 10, wherein the first and second fin portions are joined to each other along a one-time breakable preferential area of weakness to inhibit tampering with the package prior to being opened.

12. The fastener of claim 11, wherein the preferential area of weakness is selected from the group consisting of a score line, a thinned line and a highly oriented region.

13. The fastener of claim 10, wherein the first and second fin portions are joined to each other along respective lower edges thereof.

14. The fastener of claim 10, wherein the first and second fin portions are extruded with each other so as to form a single continuous fin.

15. The fastener of claim 10, wherein a combination of the first and second fin portions has a generally U-shaped or V-shaped cross-sectional configuration.

16. The fastener of claim 10, wherein the first layers of the first and second fin portions comprise material independently selected from one or more of ethylene vinyl alcohol, polyvinyl alcohol, nylon, polyester, ethylene vinyl dichloride, liquid crystal polymer, polyvinyl chloride, polyvinylidene chloride, modified polyolefins with barrier properties, polyacrylonitrile, acrylonitrile copolymers, polyacetal, or cellophane.

17. The fastener of claim 16, wherein the first layers of the first and second fin portions comprise material independently selected from one or more of ethylene vinyl alcohol, nylon, polyvinylidene chloride, or polyester.

18. The fastener of claim 16, wherein each of the first and second fin portions further includes a second layer, the second layer is a tie layer.

19. The fastener of claim 18, wherein each of the first and second fin portions further includes a third layer, the third layer is a tie layer and the first layer is located between the second and the third layers.

20. The fastener of claim 18, wherein each of the first and second fin portions further includes a third layer, the third layer is made from a polyolefin, the second layer is located between the first layer and the third layer.

21. The fastener of claim 10, wherein at least one of the fin portions includes an oxygen scavenger or an oxygen absorber.

22. The fastener of claim 10, wherein at least one of the fin portions includes a filler.

23. The fastener of claim 22, wherein the filler is talc, clay, mica or a nanocomposite.

24. The fastener of claim 10, wherein the first and second fin portions have an oxygen transmission rate less than 100 $cm^3$ (mil)/100 $in^2$ (d)(atm) at 23° C. as measured by ASTM D3985-81.

25. The fastener of claim 24, wherein the first and second fin portions have an oxygen transmission rate less than 20 $cm^3$ (mil)/100 $in^2$ (d)(atm) at 23° C. as measured by ASTM D3985-81.

26. The fastener of claim 25, wherein the first and second fin portions have an oxygen transmission rate less than 10 $cm^3$ (mil)/100 $in^2$ (d)(atm) at 23° C. as is measured by ASTM D3985-81.

27. A reclosable package, comprising:

a pair of opposing wall panels joined along a pair of opposing sides and a bottom bridging the opposing sides to create a receptacle space having a mouth end opposite the bottom;

a reclosable seal extending along the mouth end and including first and second opposing reclosable elements, the first and second reclosable elements being releasably engageable to each other; and a barrier partition formed by first and second fin portions extending downward from the respective first and second reclosable elements and being joined to each other, the barrier partition extending substantially across the pair of opposing wall panels in the receptacle space and being located below the recloseable seal, the barrier partition comprising at least a first layer that is substantially impermeable to at least one of oxygen, nitrogen and carbon dioxide.

28. A reclosable package, comprising:

a pair of opposing wall panels joined along a pair of opposing sides and a bottom bridging the opposing sides to create a receptacle space having a mouth end opposite the bottom;

a reclosable seal extending along the mouth end and including first and second opposing reclosable elements, the first and second reclosable elements being releasably engageable to each other; and a barrier partition formed by first and second fin portions extending downward from the respective first and second reclosable elements and being joined to each other, the barrier partition extending substantially across the pair of opposing wall panels in the receptacle space and being located below the recloseable seal, the barrier partition comprising at least a first layer that includes a material selected from one or more of ethylene vinyl alcohol, polyvinyl alcohol, nylon, polyester, ethylene vinyl dichloride, liquid crystal polymer, polyvinyl chloride, polyvinylidene chloride, modified polyolefins with barrier properties, polyacrylonitrile, acrylonitrile copolymers, polyacetals, or cellophane.

29. The reclosable package of claim 5, wherein the barrier partition is formed by first and second fin portions extending downward from the respective first and second reclosable elements and are joined to each other.

30. The reclosable package of claim 5, wherein the barrier partition is formed by at least one integral extension of at least one opposing wall panel.

31. The reclosable package of claim 30, wherein the barrier partition is formed by integral extensions of the opposing wall panels.

32. The reclosable package of claim 9, wherein the barrier partition is formed by first and second fin portions extending downward from the respective first and second reclosable elements and are joined to each other.

33. The reclosable package of claim 9, wherein the barrier partition is formed by at least one integral extension of at least one opposing wall panel.

34. The reclosable package of claim 27, wherein the first and second fin portions are joined to each other along a one-time breakable preferential area of weakness to inhibit tampering with the package prior to being opened.

35. The reclosable package of claim 34, wherein the preferential area of weakness is selected from the group consisting of a score line, a thinned line and a highly oriented region.

36. The reclosable package of claim 27, wherein the first and second fin portions are joined to each other along respective lower edges thereof.

37. The reclosable package of claim 27, wherein the first and second fin portions are extruded with each other so as to form a single continuous fin.

38. The reclosable package of claim 37, wherein the single continuous fin has a one-time breakable preferential area of weakness to inhibit tampering with the package prior to being opened.

39. The reclosable package of claim 27, wherein a combination of the first and second fin portions has a generally U-shaped or V-shaped cross-sectional configuration.

40. The reclosable package of claim 27, wherein the first layer of the barrier partition comprises one or more of ethylene vinyl alcohol, polyvinyl alcohol, nylon, polyester, ethylene vinyl dichloride, liquid crystal polymer, polyvinyl chloride, polyvinylidene chloride, modified polyolefins with barrier properties, polyacrylonitrile, acrylonitrile copolymers, polyacetal, or cellophane.

41. The reclosable package of claim 27, wherein the first layer of the barrier partition comprises one or more of ethylene vinyl alcohol, nylon, polyvinylidene chloride, or polyester.

42. The reclosable package of claim 27, wherein the barrier partition includes an oxygen scavenger or an oxygen absorber.

43. The reclosable package of claim 27, wherein the barrier partition includes a filler.

44. The reclosable package of claim 43, wherein the filler is talc, clay, mica or a nanocomposite.

45. The reclosable package of claim 27, wherein the barrier partition further includes a second layer, the second layer is a tie layer.

46. The reclosable package of claim 45, wherein the barrier partition further includes a third layer, the third layer is a tie layer and the first layer is located between the second and the third layers.

47. The reclosable package of claim 45, wherein the barrier partition further includes a third layer, the third layer comprises a polyolefin, the second layer is located between the first and the third layers.

48. The reclosable package of claim 45, wherein the barrier partition further includes a third layer and a fourth layer, the third layer is a tie layer, the fourth layer comprises a polyolefin and is located adjacent to the third layer, the third layer is located between the fourth and first layers, and the first layer is located between the second and third layers.

49. The reclosable package of claim 48, wherein the barrier partition further includes a fifth layer, the fifth layer comprises a polyolefin and is located adjacent to the second layer, the second layer is located between the fifth and first layers.

50. The reclosable package of claim 47, wherein the first layer of the barrier partition comprises one or more of ethylene vinyl alcohol, polyvinylidene chloride, nylon, or polyester.

51. The reclosable package of claim 45, wherein the second layer comprises one or more of ethylene vinyl acetate, anhydride modified polyolefins, anhydride modified ethylene-acrylates, anhydride modified ethylene vinyl acetate, acid modified ethylene vinyl acetate, acid modified ethylene-acrylate, or amorphous polyolefin-modified ethylene vinyl acetate.

52. The reclosable package of claim 27, wherein the first reclosable element includes a first locking profile and the second reclosable element includes a second locking profile, and further including a slider mechanism slidably mounted to the first and second locking profiles for movement between a closed position and an open position, the first and second profiles being engaged to each other while the slider mechanism is in the closed position, the first and second profiles being disengaged from each other in response to movement of the slider mechanism to the open position.

53. The reclosable package of claim 27, wherein the first layer has an oxygen transmission rate less than 100 $cm^3$ (mil)/100 $in^2$ (d)(atm) at 23° C. as measured by ASTM D3985-81.

54. The reclosable package of claim 53, wherein the first layer has an oxygen transmission rate less than 20 $cm^3$ (mil)/100 $in^2$ (d) (atm) at 23° C. as measured by ASTM D3985-81.

55. The reclosable package of claim 54, wherein the first layer has an oxygen transmission rate less than 10 $cm^3$ (mil)/100 $in^2$ (d) (atm) at 23° C. as measured by ASTM D3985-81.

56. The reclosable package of claim 27, wherein each of the opposing wall panels further comprises at least a first layer that is substantially impermeable to at least one of oxygen, nitrogen and carbon dioxide.

57. The reclosable package of claim 56, wherein the first layer of each of the respective opposing wall panels comprises material independently selected from one or more of ethylene vinyl alcohol, polyvinyl alcohol, nylon, polyester, ethylene vinyl dichloride, liquid crystal polymer, polyvinyl chloride, polyvinylidene chloride, modified polyolefins with barrier properties, polyacrylonitrile, acrylonitrile copolymers, polyacetal, or cellophane.

58. The reclosable package of claim 56, wherein each of the opposing wall panels further includes a second layer, the second layer is a tie layer.

59. The reclosable package of claim 28, wherein the first and second fin portions are joined to each other along a one-time breakable preferential area of weakness to inhibit tampering with the package prior to being opened.

60. The reclosable package of claim 59, wherein the preferential area of weakness is selected from the group consisting of a score line, a thinned line and a highly oriented region.

61. The reclosable package of claim 28, wherein the first and second fin portions are joined to each other along respective lower edges thereof.

62. The reclosable package of claim 28, wherein the first and second fin portions are extruded with each other so as to form a single continuous fin.

63. The reclosable package of claim 62, wherein the single continuous fin has a one-time breakable preferential area of weakness to inhibit tampering with the package prior to being opened.

64. The reclosable package of claim 28, wherein a combination of the first and second fin portions has a generally U-shaped or V-shaped cross-sectional configuration.

65. The reclosable package of claim 28, wherein the first layer of the barrier partition comprises one or more of ethylene vinyl alcohol, nylon, polyvinylidene chloride, or polyester.

66. The reclosable package of claim 28, wherein the barrier partition includes an oxygen scavenger or an oxygen absorber.

67. The reclosable package of claim 28, wherein the barrier partition includes a filler.

68. The reclosable package of claim 67, wherein the filler is talc, clay, mica or a nanocomposite.

69. The reclosable package of claim 28, wherein the barrier partition further includes a second layer, the second layer is a tie layer.

70. The reclosable package of claim 69, wherein the barrier partition further includes a third layer, the third layer is a tie layer and the first layer is located between the second and the third layers.

71. The reclosable package of claim 69, wherein the barrier partition further includes a third layer, the third layer comprises a polyolefin, the second layer is located between the first and the third layers.

72. The reclosable package of claim 69, wherein the barrier partition further includes a third layer and a fourth layer, the third layer is a tie layer, the fourth layer comprises a polyolefin and is located adjacent to the third layer, the third layer is located between the fourth and first layers, and the first layer is located between the second and third layers.

73. The reclosable package of claim 72, wherein the barrier partition further includes a fifth layer, the fifth layer comprises a polyolefin and is located adjacent to the second layer, the second layer is located between the fifth and first layers.

74. The reclosable package of claim 71, wherein the first layer of the barrier partition comprises one or more of ethylene vinyl alcohol, polyvinylidene chloride, nylon, or polyester.

75. The reclosable package of claim 69, wherein the second layer comprises one or more of ethylene vinyl acetate, anhydride modified polyolefins, anhydride modified ethylene-acrylates, anhydride modified ethylene vinyl acetate, acid modified ethylene vinyl acetate, acid modified ethylene-acrylate, or amorphous polyolefin-modified ethylene vinyl acetate.

76. The reclosable package of claim 28, wherein the first reclosable element includes a first locking profile and the second reclosable element includes a second locking profile, and further including a slider mechanism slidably mounted to the first and second locking profiles for movement between a closed position and an open position, the first and second profiles being engaged to each other while the slider mechanism is in the closed position, the first and second profiles being disengaged from each other in response to movement of the slider mechanism to the open position.

77. The reclosable package of claim 28, wherein the first layer has an oxygen transmission rate less than 100 $cm^3$ (mil)/100 $in^2$ (d)(atm) at 23° C. measured by ASTM D3985-81.

78. The reclosable package of claim 77, wherein the first layer has an oxygen transmission rate less than 20 $cm^3$ (mil)/100 $in^2$ (d) (atm) at 23° C. as measured by ASTM D3985-81.

79. The reclosable package of claim 78, wherein the first layer has an oxygen transmission rate less than 10 $cm^3$ (mil)/100 $in^2$ (d) (atm) at 23° C. as measured by ASTM D3985-81.

80. The reclosable package of claim 28, wherein each of the opposing wall panels further comprises at least a first layer that is substantially impermeable to at least one of oxygen, nitrogen and carbon dioxide.

81. The reclosable package of claim 80, wherein the first layer of each of the respective opposing wall panels comprises material independently selected from one or more of ethylene vinyl alcohol, polyvinyl alcohol, nylon, polyester, ethylene vinyl dichloride, liquid crystal polymer, polyvinyl chloride, polyvinylidene chloride, modified polyolefins with barrier properties, polyacrylonitrile, acrylonitrile copolymers, polyacetal, or cellophane.

82. The reclosable package of claim 80, wherein each of the opposing wall panels further includes a second layer, the second layer is a tie layer.

* * * * *